US006631623B1

(12) United States Patent
Ball

(10) Patent No.: US 6,631,623 B1
(45) Date of Patent: Oct. 14, 2003

(54) CONDENSATE DRAIN COUPLING AND METHOD OF USE THEREOF

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 10/235,864

(22) Filed: Sep. 5, 2002

(51) Int. Cl.[7] ..... F25D 21/14; F25D 21/00
(52) U.S. Cl. ..... 62/285; 62/272
(58) Field of Search ..... 62/272, 285, 288

(56) References Cited

U.S. PATENT DOCUMENTS

| | | | | | |
|---|---|---|---|---|---|
| 695,311 | A | * | 3/1902 | Hickey | 210/163 |
| 934,188 | A | | 9/1909 | Kirby | |
| 2,072,427 | A | * | 3/1937 | O'Brien | 62/271 |
| 2,077,021 | A | * | 4/1937 | Sites | 62/150 |
| 2,140,829 | A | * | 12/1938 | Child | 62/97 |
| 3,150,383 | A | * | 9/1964 | Reich | 4/533 |
| 4,937,559 | A | * | 6/1990 | Meacham et al. | 340/618 |
| 5,890,241 | A | | 4/1999 | Ball | |
| 6,041,611 | A | * | 3/2000 | Palmer | 62/286 |
| 6,132,138 | A | * | 10/2000 | Haese | 405/37 |

FOREIGN PATENT DOCUMENTS

JP 6-272965 * 9/1994

OTHER PUBLICATIONS

WATCO MFG. CO.; Overflow Elbow w/Drain; Nov. 22, 1991; 1 pg.

* cited by examiner

*Primary Examiner*—William C. Doerrler

(57) ABSTRACT

A condensate drain system has a condensate tube into which flows the condensate from a condensing device such as an air conditioner unit. The condensate then flows through the condensate tube and the tube is connected to a wastewater disposal system. A condensate port is provided in the wastewater disposal system coupling to facilitate the connection of the condensate tube to the wastewater disposal system.

2 Claims, 3 Drawing Sheets

CONDENSATE DRAIN COUPLING AND METHOD OF USE THEREOF

BACKGROUND OF THE INVENTION

Air conditioning units are typically drained via a flexible tube that drains directly from the condensate receiving pan to the outside air or through make-shift connections to wastewater disposal systems. Draining directly creates a nuisance and unsightliness of dripping from the condensate tube. Individually adapting the wastewater system to accept the condensate tube is inefficient and may lead to ineffective results.

It is, therefore, a principal object of this invention to provide a method and means for installing a condensate drain system for air conditioners and other condensate draining devices that will safely, efficiently, and effectively drain condensate into the wastewater disposal system.

This and other objects of this invention will be apparent to those skilled in the art.

SUMMARY OF THE INVENTION

A condensate drain system has a condensate tube into which flows the condensate from a condensing device such as an air conditioner unit. The condensate then flows through the condensate tube and is connected to a fitting within the wastewater system of the building which also performs a normal function of draining wastewater. Preferably, that fitting is associated with a bathtub overflow drain.

DESCRIPTION OF THE PREFERRED EMBODIMENT

Figure 1:
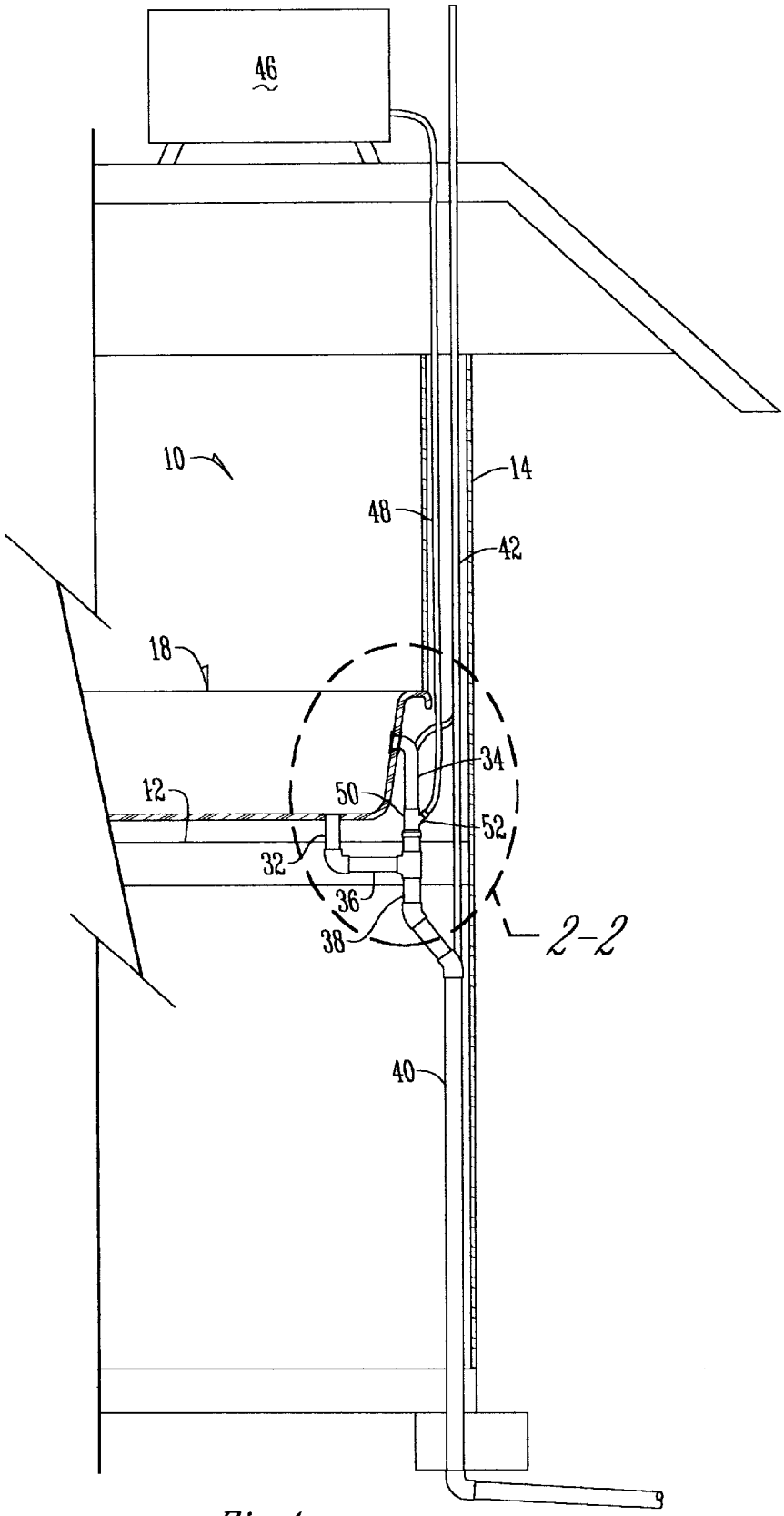
FIG. 1 is a sectional view through a conventional home showing a condensate drain coupling of this invention.
Figure 2:
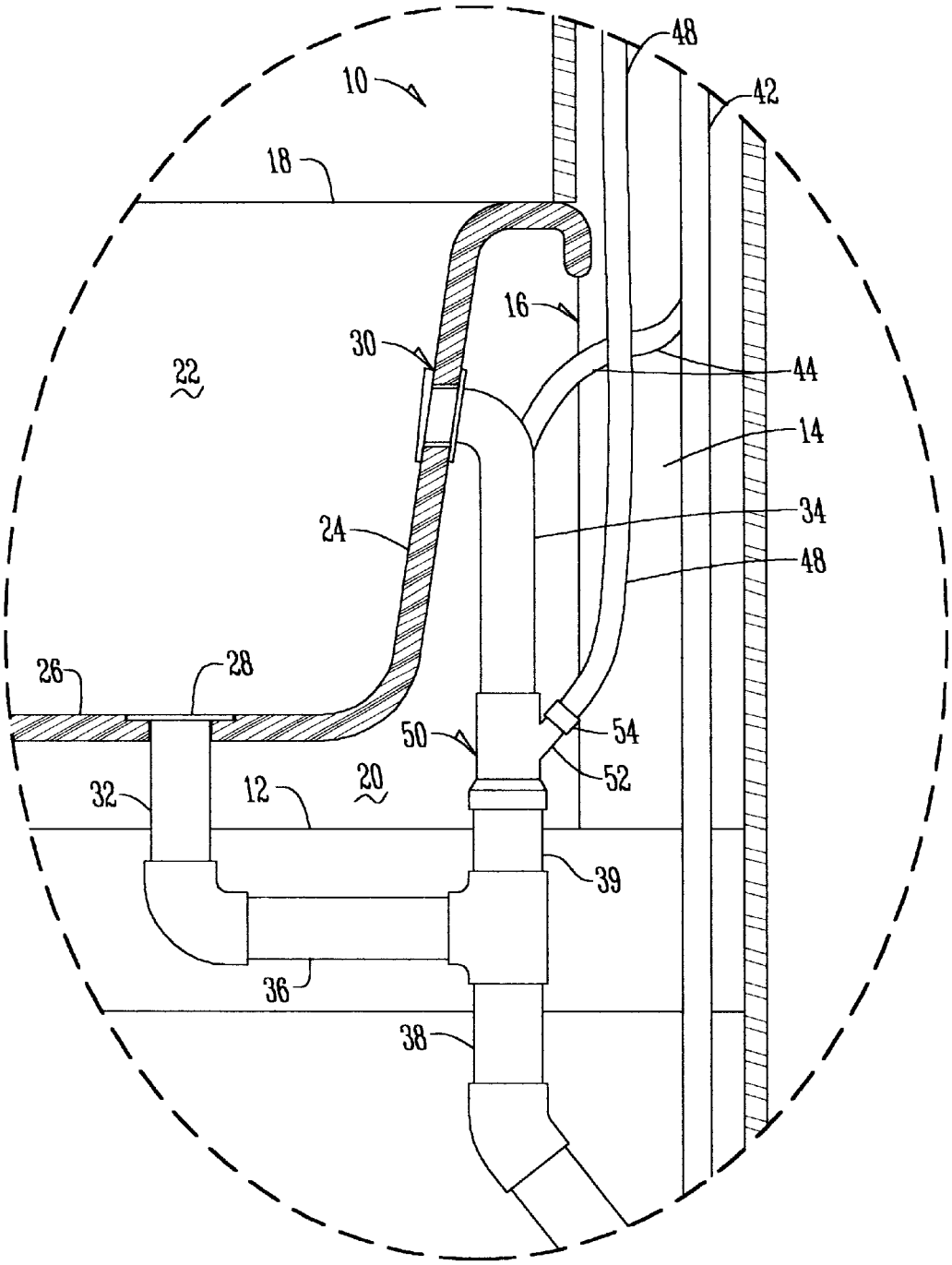
FIG. 2 is a large scale sectional view of a bathtub overflow and wastewater disposal system in communication with the condensate drain coupling and the condensate tube of the present invention.

With reference to FIGS. 1 and 2, a conventional bathroom structure 10 has a floor 12 and a hollow wall 14 with a wall opening 16 therein. A conventional bathtub 18 has a base 20 which rests upon floor 12. Sidewalls 22 extend upwardly from base 20 as does an end wall 24. A bottom 26 dwells in spaced relation to the floor 12.

A conventional waste water drain port 28 is located in bottom 26. A conventional overflow port 30 is located in the end wall 24. A vertical first conduit drain pipe 32 extends downwardly from the drain port 28, and overflow drain pipe 34 extends downwardly from overflow port 30. A horizontal second conduit pipe 36 connects pipes 32 and 34. A drain pipe 38 extends downwardly from the junction between pipes 34 and 36 and is connected to a soil pipe 40.

A conventional vertical vent pipe 42 is located within.the hollow wall 14. Pipe 44 interconnects vent pipe 42 and the upper end of overflow drain pipe 34.

A conventional air conditioner unit 46 is located structurally above the tub 18 (FIG. 1). Water vapor condensed by the air conditioner unit 46 is conveyed by a third conduit condensate discharge tube 48 via gravity to a hollow fitting as a condensate drain coupling 50 (FIG. 2) and is connected thereto at the distal end of the condensate port 52 via a coupling 54.

Figure 3:
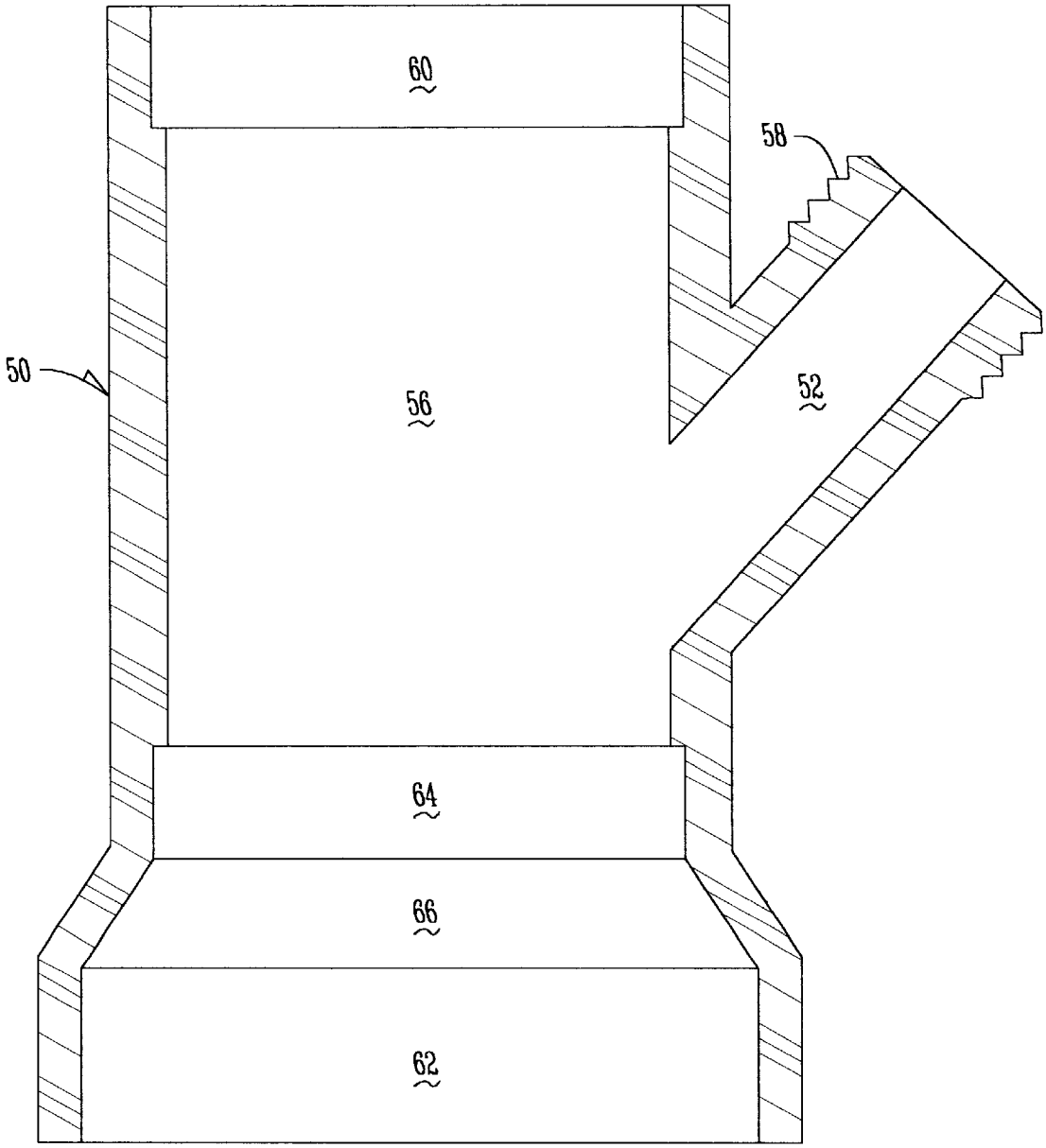
FIG. 3 is a sectional view of the condensate drain coupling.

With reference to FIG. 3, the condensate drain coupling 50 has a main body 56 and a condensate port 52 which is attached medially to the body and extends upwardly and outwardly. The outside of the distal end of the condensate port 52 includes threads 58 for receipt of a threaded coupling for connection to the lower end of tube 48. Alternatively, the distal outside surface of the condensate port may be smooth and unthreaded to be secured to tube 48, by an adhesive-connected coupling.

The condensate drain coupling 50 has a top end 60 which is the end located nearest the distal end of the condensate tube 52. The top end 60 is sufficient to receive the overflow drain pipe 34. The bottom end of the condensate drain coupling 50 has a larger diameter receiver 62 and a smaller diameter receiver 64 which are joined by a transition area 66 and which are sufficient to receive alternate sizes of the connecting pipe 39.

In operation, the condensate drain is installed as shown in FIG. 2; the conventional overflow drain pipe 34 and condensate tube 48 and connecting pipe 39 are also installed as shown. The conventional overflow drain pipe 34 is affixed to the top end 60, and the opposite end of the condensate drain coupling 50 is attached to the connecting pipe 39 at the larger diameter receiver 62 or at the smaller diameter receiver 64 in such that a wastewater may flow from the conventional overflow drain pipe into the condensate drain coupling 50 and continue to flow into the connecting pipe 39 and on toward the wastewater pipe 38. Also in operation, the condensate tube 48 is attached to the condensate drain port 52 via a coupling 54 such that condensate may flow from the condensate tube 48 through the coupling 54 into the condensate port 52 and through the condensate drain coupling 50 to the connecting pipe 39 and continue to flow to the wastewater pipe 38 and continue to flow to and down the soil pipe.

It is, therefore, seen that the condensate drain coupling 50 efficiently connects a conventional air conditioning unit 46 to the soil pipe 40 for the efficient removal of condensate.

It is, therefore, seen that this invention will achieve at least all of its stated objectives.

What is claimed is:

1. A bathtub overflow assembly having a first conduit connectable to an overflow port on a vertical wall of a bathtub and including a second conduit connectable to a waste water drain in a bottom of the bathtub and being connectable to a waste water disposal system, comprising:

a hollow fitting fluidly connecting the first and second conduits, and a third conduit in fluid connection with the hollow fitting and extending upwardly and away therefrom for connection to an air conditioner unit located at an elevation above the bathtub.

2. A method of draining condensate fluid from an air conditioner at an elevated level on a building having a bathtub with a waste water disposal assembly located at a lower level of the building and connected to a waste water disposal system, comprising:

connecting a first conduit to an overflow port on a vertical wall of a bathtub;

connecting a second conduit to a waste water drain in a bottom of the bathtub and being connectable to a waste water disposable system;

providing a hollow fitting ti fluidly connect the first and second conduits;

connecting a lower end of a third conduit in fluid connection with the hollow fitting; and connecting an upper end of the third conduit to an air conditioner unit located above the bathtub.

* * * * *